US009896243B2

(12) United States Patent
Li et al.

(10) Patent No.: US 9,896,243 B2
(45) Date of Patent: Feb. 20, 2018

(54) LIQUID STOPPER AND ELECTRONIC CIGARETTE USING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Hongxing Duan, Shenzhen (CN); Long Cai, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 810 days.

(21) Appl. No.: 14/341,748

(22) Filed: Jul. 25, 2014

(65) Prior Publication Data

US 2015/0128973 A1 May 14, 2015

(30) Foreign Application Priority Data

Nov. 12, 2013 (CN) ..... 2013 2 0708720

(51) Int. Cl.
*A24F 47/00* (2006.01)
*B65D 39/00* (2006.01)

(52) U.S. Cl.
CPC ..... *B65D 39/0052* (2013.01); *A24F 47/008* (2013.01)

(58) Field of Classification Search
None
See application file for complete search history.

(56) References Cited

U.S. PATENT DOCUMENTS

2014/0060524 A1* 3/2014 Liu ..... A24F 47/008 128/200.14
2014/0299139 A1* 10/2014 Liu ..... A24F 47/008 131/329
2015/0181939 A1* 7/2015 Liu ..... A24F 47/008 131/329

FOREIGN PATENT DOCUMENTS

WO WO 2013149404 A1 * 10/2013 ..... A24F 47/008

* cited by examiner

*Primary Examiner* — Alison L Hindenlang
*Assistant Examiner* — Jamel M Nelson
(74) *Attorney, Agent, or Firm* — Cheng-Ju Chiang

(57) ABSTRACT

A liquid stopper for an electronic cigarette, includes a main body configured for stopping a tobacco liquid of the electronic cigarette. The main body includes a bottom surface, at least one wire hole in communication with the bottom surface, and at least one wire groove formed in the bottom surface and in communication with the at least one wire hole. The at least one wire hole is configured to receive at least one conductive wire of the electronic cigarette, and the at least one wire groove is configured to guide the at least one conductive wire to a peripheral wall of the main body. An electronic cigarette using the liquid stopper is also provided.

10 Claims, 5 Drawing Sheets

LIQUID STOPPER AND ELECTRONIC CIGARETTE USING SAME

BACKGROUND

1. Technical Field

The present invention relates to electronic cigarettes, and particularly to a liquid stopper used in an electronic cigarette and an electronic cigarette using same.

2. Description of Related Art

Electronic cigarettes are similar to conventional cigarettes in appearance and taste, but less harmful to human's health, so that electronic cigarettes are widely used for helping people to quit smoke. Electronic cigarettes usually have a tobacco liquid filled therein, and liquid stoppers are widely used for preventing the tobacco liquid from leaking out.

In a typical electronic cigarette, a heating assembly is arranged at a middle position of a liquid reservoir, and a liquid stopper is arranged under the liquid reservoir. Conductive wires of the heating assembly have to extend through the liquid reservoir to be electrically connected to electrodes or batteries. However, the conductive wires may make the liquid stopper difficult to sit on another component in the electronic cigarette, thus the entire arrangement is hard to be compact.

What is needed, therefore, is a liquid stopper and an electronic cigarette which can overcome the above shortcomings.

BRIEF DESCRIPTION OF THE DRAWINGS

Many aspects of the present liquid stopper and electronic cigarette can be better understood with reference to the following drawings. The components in the drawings are not necessarily drawn to scale, the emphasis instead being placed upon clearly illustrating the principles of the present liquid stopper and electronic cigarette. Moreover, in the drawings, like reference numerals designate corresponding parts throughout the several views.

DETAILED DESCRIPTION

Embodiments of the present liquid stopper and electronic cigarette will now be described in detail below and with references to the drawings.

Figure 1:
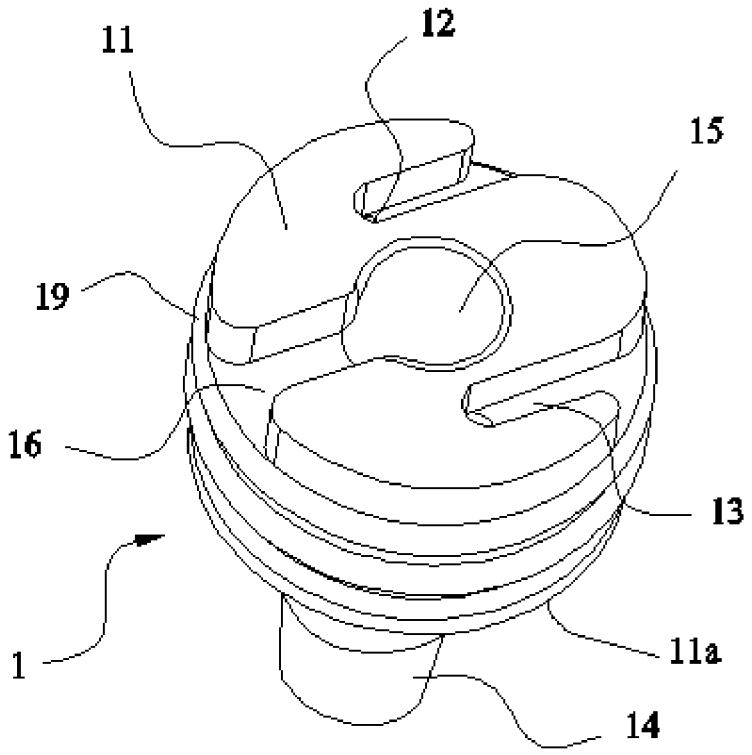
FIG. 1 is a schematic isometric view of a liquid stopper in accordance with a first embodiment.

Referring to FIG. 1, a liquid stopper 1 used in an electronic cigarette, is provided. The liquid stopper 1 is a stopper for stopping a tobacco liquid from leaking out of an atomizing device of the electronic cigarette. In particular, the electronic cigarette has a liquid reservoir defined in the atomizing device, and a heating assembly configured for heating and atomizing the tobacco liquid. The heating assembly includes a heating coil having two ends connected to electrodes by conductive wires (labeled as "2" in FIG. 3). The liquid stopper 1 may be arranged near the liquid reservoir and under the heating assembly. The detail configuration of the liquid stopper 1 is described as following.

The liquid stopper 1 has a main body 19, and the main body 19 mainly includes a bottom surface 11, an opposite top surface 11*a*, and two wire holes 12 formed through the bottom surface 11 and the top surface 11*a*. In the present disclosure, two wire grooves 13 are further formed in the bottom surface 11 and are in communication with the respective wire holes 12. Each of the wire holes 12 is configured for receiving a conductive wire 2 of the electronic cigarette, and each of the wire grooves 13 is configured for receiving and guiding the corresponding conductive wire 2 to a sidewall of the liquid stopper 1. Due to the wire grooves 13, the conductive wires 2 would not interfere the bottom surface 11, and the bottom surface 11 can be directly disposed on an adjacent components, or the bottom surface 11 of the liquid stopper 1 can closely contact another components, such that the arrangement can be compact.

The liquid stopper 1 further has a column 14 formed on the top surface 11*a* of the main body, and a central through hole 15 formed through the column 14 and the main body 19. The column 14 is configured for being engaged with a component of the atomizing device.

In the present disclosure, a first air channel 16 is formed in the bottom surface 11 and in communication with the central through hole 15. The first air channel 16 extends to an outside of the liquid stopper 1.

In detail, the main body 19 may be cylindrical shaped, the bottom surface 11 may be a flat round surface, the first air channel 16 is arranged along a diameter, and the two wire grooves 13 are symmetrically arranged about the diameter of the bottom surface 11.

Figure 2:
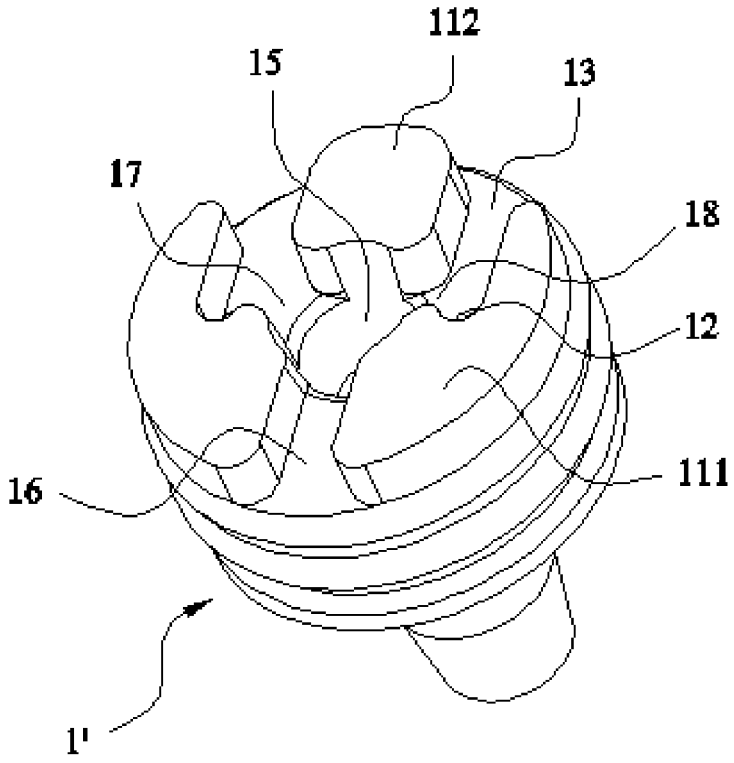
FIG. 2 is a schematic isometric view of a liquid stopper in accordance with an alternative embodiment.

Referring to FIG. 2, in an alternative embodiment, a second air channel 17 and a third air channel 18 are formed in the bottom surface 11 of the liquid stopper 1'. The second air channel 17 and the third air channel 18 are in communicated with the central through hole 15, and are in communication with the respective wire grooves 13. In the present embodiment, the second air channel 17 interconnects the corresponding wire groove 13, the third air channel 18 interconnects the corresponding wire groove 13, and the bottom surface 11 are divided into a pair of first regions 111 symmetrically about the first air channel 16, and a second region 112 extending along a radius of the bottom surface 11. The configuration of the liquid stopper 1' increases air entering the central through hole 15, and thus avoiding short of breath in sucking the electronic cigarette.

Figure 3:
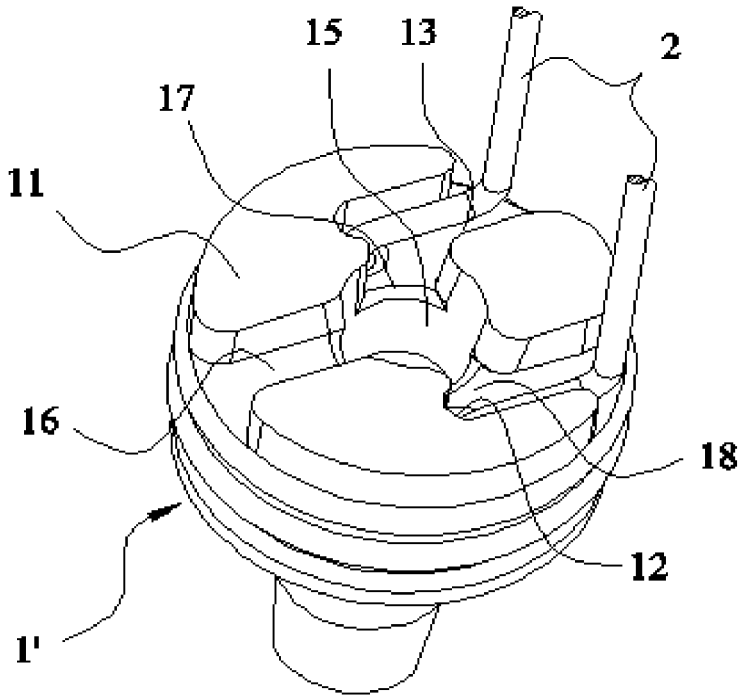
FIG. 3 shows conductive wires extend through the liquid stopper of FIG. 2 and lie in the wire grooves of the liquid stopper.

Referring to FIG. 3, conductive wires 2 of a heating coil of a heating assembly extend through the respective wire holes 12 and extend out from the respective wire grooves 13, thus the bottom surface 11 can directly sit on another component without interference of the conductive wires 2. The flat bottom surface 11 makes the liquid stopper 1' can closely contact with a flat adjacent component, thereby the entire arrangement can be compact.

In other embodiments, the bottom surface 11 can be in different shapes as long as the bottom surface 11 can large area surface contact an adjacent component in the electronic cigarette.

In addition, in some embodiments, the wire holes 12 and the wire grooves 13 can be changed to one wire hole and one wire groove, as long as the conductive wires 2 are insulatedly spaced in the wire hole and in the wire groove.

Figure 4:
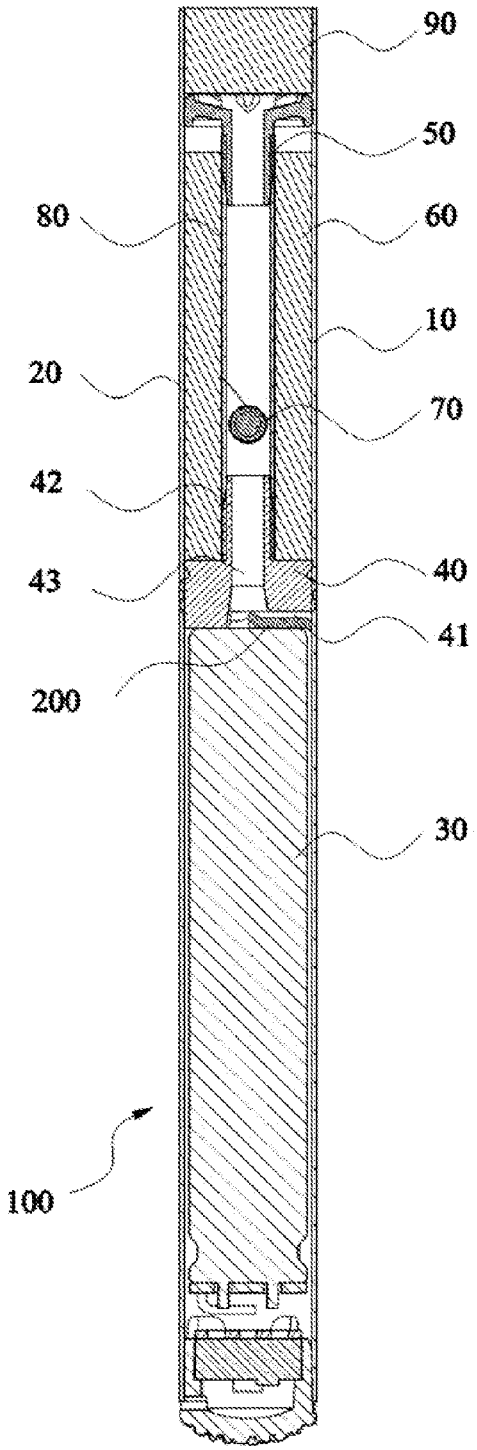
FIG. 4 is a schematic cross sectional view of an electronic cigarette in accordance with a second embodiment.

Referring to FIG. 4, an electronic cigarette 100 in accordance with a second embodiment is provided. The electronic cigarette 100 includes a shell 10, and an atomizing device 20, a power device 30 and a lower liquid stopper 40 received in the shell 10. The lower liquid stopper 40 is located between the atomizing device 20 and the power device 30.

The power device 30 has a battery. The atomizing device 20 has a heating assembly 70, and the heating assembly 70 is electrically connected to the battery through two conductive wires 200. The lower liquid stopper 40 is the same as one of the liquid stoppers described above. The conductive wires 200 of the heating assembly 70 extend through the wire holes (not labeled) and lie in the wire grooves 41 of the lower liquid stopper 40 to allow the bottom surface of the liquid stopper 40 closely contact the battery. In this way, a larger inner space can be given to a liquid reservoir of the atomizing device 20 or the battery of the power device 30, such that a greater aerosol can be sucked in sucking this electronic cigarette at one time.

Figure 5:
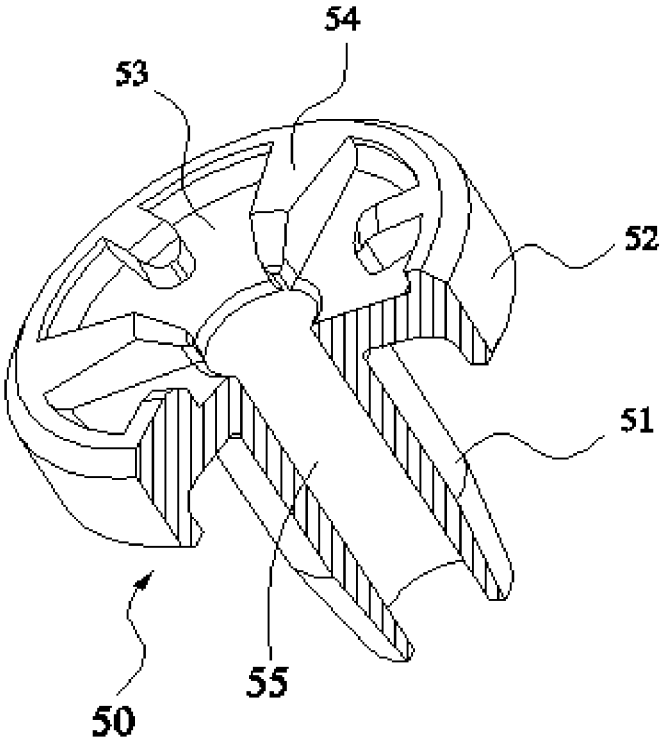
FIG. 5 is a schematic isometric view of an upper liquid stopper used in the electronic cigarette of FIG. 4.

Referring also to FIG. 5, the atomizing device 20 further includes an upper liquid stopper 50, the liquid reservoir is defined between the upper liquid stopper 50 and the lower liquid stopper 40, and the liquid reservoir has a liquid reserving cotton 60 filled therein. The upper liquid stopper 50 includes a main body 52, a column 51 extending downwards from the main body 52, and a central through hole 55 formed through the main body 52 and the column 51. The main body 52 includes a tapering reflow portion 53, and a number of supports 54 formed on the reflow portion 53 and opposite to the column 51.

The liquid reserving cotton 60 surrounds an air pipe 80, the column 42 of the lower liquid stopper 40 and the column 51 of the upper liquid stopper 50 engage in two ends of the air pipe 80, and the main body of the lower liquid stopper 40 and the main body 52 of the upper liquid stopper 50 engage in the shell 10. The heating assembly 70 is arranged at a middle portion of the air pipe 80, and the conductive wires 200 of the heating assembly 70 extend through the lower liquid stopper 40 and lie in the wire grooves 41 of the lower liquid stopper 40 to be electrically connected to the battery. Air enters the lower liquid stopper 40 from the air channels (not labeled) and the central wire hole 43 of the lower liquid stopper 40, and reaches the air pipe 80 and the heating assembly 70 to form aerosol when the heating assembly 70 heats and atomizes the tobacco liquid, and the aerosol is sucked out from the central through hole 55 of the upper liquid stopper 50. The reflow portion 53 allows condensed tobacco liquid in the aerosol to reflow along an inner wall of the central through hole 55 and an inner wall of the air pipe 80 to reach the heating assembly 70.

In addition, the electronic cigarette 100 further includes a filter 90 arranged at an end of the shell 10, and abutting on the support 54 of the upper liquid stopper 50. The filter 90 can be made of cotton, acetate fiber, polyester fiber, porous foam or other similar material. The filter 90 can filter out greater particles in the aerosol, thereby purifying the aerosol.

Furthermore, the filter 90 makes the electronic cigarette appears more similar to a conventional cigarette, thus the electronic cigarette is more popular by users.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A liquid stopper for an electronic cigarette having an atomizing device, a power device and a liquid reservoir located around the atomizing device, the liquid stopper located between the power device and the liquid reservoir, and comprising a main body configured for stopping a tobacco liquid in the liquid reservoir of the electronic cigarette via directly engaging against the liquid reservoir, wherein the main body comprises a bottom surface configured for directly engaging against the power device, at least one wire hole extends through the main body along an axial direction of the main body and is in communication with the bottom surface, and at least one wire groove is formed on and recessed from the bottom surface and in communication with the at least one wire hole by extending along a radial direction of the bottom surface to be opened at a peripheral wall of the main body located around the bottom surface, the at least one wire hole is configured to receive at least one conductive wire of the electronic cigarette, and the at least one wire groove is configured to guide the at least one conductive wire to the peripheral wall of the main body.

2. The liquid stopper of claim 1, wherein the at least one wire hole comprises two wire holes, the at least one wire groove comprises two wire grooves, the wire holes are symmetrically arranged about a center of the bottom surface, and the wire grooves are symmetrically arranged about the center of the bottom surface.

3. The liquid stopper of claim 2, wherein the main body further comprises a top surface opposite to the bottom surface, the liquid stopper further comprises a column extending upwards from the top surface, and a central through hole formed through the column and the main body.

4. The liquid stopper of claim 3, wherein the main body further comprises a first air channel formed on and recessed from the bottom surface, and the first air channel is in communication with the central through hole and extends to be opened at the peripheral wall of the main body.

5. The liquid stopper of claim 4, wherein the wire grooves are symmetrically arranged about the first air channel.

6. The liquid stopper of claim 4, wherein the main body further comprises a second air channel and a third air channel formed in the bottom surface, the second air channel and the third air channel are in communication with the central through hole and interconnected to the respective wire grooves, and the first air channel, the second air channel and the third air channel cooperatively divide the bottom surface into three regions.

7. An electronic cigarette comprising a shell, an atomizing device, a power device and a lower liquid stopper, the atomizing device, the power device and the lower liquid stopper being received in the shell, and the lower liquid stopper being located between the atomizing device and the power device, wherein the lower liquid stopper is the liquid stopper as claimed in claim 1.

8. The electronic cigarette of claim 7, wherein the atomizing device further includes an upper liquid stopper, and the upper liquid stopper and the lower liquid stopper cooperatively define a liquid reserving space therebetween.

9. The electronic cigarette of claim 8, wherein the upper liquid stopper comprises a tapering reflow portion recessed from a side face of the upper liquid stopper, the tapering reflow portion is spatially communicated with a central through hole extending through the upper liquid stopper for spatially communicating with an air pipe residing in the atomizing device.

10. The electronic cigarette of claim 9, further comprising a filter arranged on the upper liquid stopper.

* * * * *